US007815789B2

(12) United States Patent
Wardle et al.

(10) Patent No.: US 7,815,789 B2
(45) Date of Patent: Oct. 19, 2010

(54) PROCESS TO PREPARE A LUBRICATING BASE OIL

(75) Inventors: Peter James Wardle, London (GB); William Leonard Alexander King, London (GB)

(73) Assignee: Shell Oil Company, Houston, TX (US)

( * ) Notice: Subject to any disclaimer, the term of this patent is extended or adjusted under 35 U.S.C. 154(b) by 866 days.

(21) Appl. No.: 10/561,589

(22) PCT Filed: Jun. 21, 2004

(86) PCT No.: PCT/EP2004/051181

§ 371 (c)(1),
(2), (4) Date: Feb. 14, 2007

(87) PCT Pub. No.: WO2004/113473

PCT Pub. Date: Dec. 29, 2004

(65) Prior Publication Data

US 2007/0205138 A1 Sep. 6, 2007

(30) Foreign Application Priority Data

Jun. 23, 2003 (EP) ..... 03253947

(51) Int. Cl.
*C10G 45/00* (2006.01)

(52) U.S. Cl. ..... 208/58; 208/18; 208/19; 208/46; 208/49; 208/68; 208/78

(58) Field of Classification Search ..... 208/57, 208/209–217, 46, 49, 58, 60, 78, 133, 264, 208/177
See application file for complete search history.

(56) References Cited

U.S. PATENT DOCUMENTS

| | | | | |
|---|---|---|---|---|
| 3,730,876 | A | 5/1973 | Sequeira, Jr. | 208/59 |
| 3,790,472 | A | 2/1974 | White | 208/111 |
| 4,574,043 | A | 3/1986 | Chester et al. | 208/59 |
| 4,851,109 | A | 7/1989 | Chen et al. | 208/58 |
| 4,859,311 | A | 8/1989 | Miller | 208/89 |
| 4,943,672 | A | 7/1990 | Hamner et al. | 585/737 |
| 4,990,318 | A | 2/1991 | Kidd | 423/230 |
| 5,034,119 | A | 7/1991 | Blackburn et al. | 208/309 |
| 5,053,373 | A | 10/1991 | Zones | 502/64 |
| 5,059,299 | A | 10/1991 | Cody et al. | 208/27 |
| 5,077,261 | A | 12/1991 | Schubert | 502/408 |
| 5,102,854 | A | 4/1992 | Delzer et al. | 502/410 |
| 5,108,975 | A | 4/1992 | Schubert et al. | 502/232 |
| 5,130,288 | A | 7/1992 | Delzer et al. | 502/405 |
| 5,157,191 | A | 10/1992 | Bowes et al. | 585/533 |
| 5,174,919 | A | 12/1992 | Cymbaluk et al. | 252/185 |
| 5,177,050 | A | 1/1993 | Schubert | 502/415 |
| 5,219,542 | A | 6/1993 | Lowery et al. | 423/230 |
| 5,244,641 | A | 9/1993 | Khare | 423/220 |
| 5,248,481 | A | 9/1993 | Bloom et al. | 422/171 |
| 5,252,527 | A | 10/1993 | Zones | 502/64 |
| 5,281,445 | A | 1/1994 | Khare | 427/445 |
| 5,525,209 | A | 6/1996 | Billon et al. | 208/59 |
| 5,976,354 | A | 11/1999 | Powers et al. | 208/89 |
| 6,025,305 | A | 2/2000 | Aldrich et al. | 508/110 |
| 6,080,301 | A | 6/2000 | Berlowitz et al. | 208/18 |
| 6,165,949 | A | 12/2000 | Berlowitz et al. | 508/363 |
| 6,294,077 | B1 | 9/2001 | Dougherty et al. | 208/27 |
| 6,544,410 | B1 | 4/2003 | Gislason et al. | 208/247 |
| 6,576,120 | B1 | 6/2003 | Van Ballegoy et al. | 208/119 |
| 7,250,107 | B2 | 7/2007 | Benazzi et al. | 208/89 |
| 7,354,508 | B2 | 4/2008 | Adams et al. | 208/92 |
| 2002/0146358 | A1 | 10/2002 | Smith et al. | 422/188 |
| 2003/0088133 | A1 | 5/2003 | O'Rear | 585/323 |
| 2004/0065581 | A1 | 4/2004 | Jiang et al. | 208/18 |
| 2005/0194288 | A1 | 9/2005 | Holland et al. | 208/87 |

FOREIGN PATENT DOCUMENTS

| | | |
|---|---|---|
| AU | 698392 | 10/1998 |
| EP | 0324528 | 1/1989 |
| EP | 0582347 | 7/1993 |
| EP | 0575077 | 12/1993 |
| EP | 0699225 | 11/1994 |
| EP | 705321 | 1/1995 |
| EP | 0649896 | 4/1995 |
| EP | 0668342 | 8/1995 |
| EP | 0776959 | 6/1997 |

(Continued)

OTHER PUBLICATIONS

Gregor, J.H. (1990). Catalysis Letters, 7, pp. 317-331.*

(Continued)

*Primary Examiner*—Robert J Hill, Jr.
*Assistant Examiner*—Brian McCaig

(57) ABSTRACT

A process to prepare a base oil having a viscosity index of above 80 and a saturates content of above 90 wt % from a crude derived feedstock by (a) contacting a crude derived feedstock in the presence of hydrogen with a catalyst having at least one Group VIB metal component and at least one non-noble Group VIII metal component supported on a refractory oxide carrier;

(b) adding to the effluent of step (a) or part of the effluent of step (a) a Fischer-Tropsch derived fraction boiling at least partly in the base oil range in an amount effective to achieve the target viscosity index of the final base oil; and (c) dewaxing the mixture as obtained in step (b).

18 Claims, No Drawings

FOREIGN PATENT DOCUMENTS

| | | |
|---|---|---|
| EP | 0832171 | 4/1998 |
| EP | 0909304 | 4/1999 |
| EP | 0921184 | 6/1999 |
| EP | 0994173 | 9/1999 |
| EP | 1137741 | 9/2005 |
| GB | 2386904 | 10/2003 |
| GB | 2388611 | 11/2003 |
| JP | 06116572 | 4/1994 |
| NL | 1015035 | 4/2000 |
| WO | WO9201657 | 2/1992 |
| WO | WO9220759 | 11/1992 |
| WO | 94/10263 | 5/1994 |
| WO | WO9410264 | 5/1994 |
| WO | WO9500604 | 1/1995 |
| WO | 97/18278 | 5/1997 |
| WO | WO9723584 | 7/1997 |
| WO | 98/01515 | 1/1998 |
| WO | WO9802502 | 1/1998 |
| WO | WO9802503 | 1/1998 |
| WO | 99/20720 | 4/1999 |
| WO | 99/34917 | 7/1999 |
| WO | 99/45085 | 9/1999 |
| WO | WO0000571 | 1/2000 |
| WO | WO0016895 | 3/2000 |
| WO | 00/29511 | 5/2000 |
| WO | WO0027950 | 5/2000 |
| WO | WO0107538 | 2/2001 |
| WO | WO0157166 | 8/2001 |
| WO | WO0206427 | 1/2002 |
| WO | WO0208363 | 1/2002 |
| WO | 02/20513 | 3/2002 |
| WO | 02/50213 | 6/2002 |
| WO | WO0246333 | 6/2002 |
| WO | 02/064710 | 8/2002 |
| WO | 02/070630 | 9/2002 |
| WO | WO02099014 | 12/2002 |
| WO | WO03070857 | 8/2003 |
| WO | WO2004007647 | 1/2004 |
| WO | 2004/033593 | 4/2004 |
| WO | 2004/033594 | 4/2004 |
| WO | WO2004113473 | 12/2004 |
| WO | 2005/000999 | 1/2005 |

OTHER PUBLICATIONS

International Search Report dated Oct. 13, 2004 (PCT/EP2004/051181).

International Preliminary Report on Patentability (PCT/EP2004/051181).

Chapter 6, Lubricant Base Oil and Wax Processing, Avilino Sequeira, Jr., Marcel Dekker, Inc., NY 1994.

Chapter 7, Lubricant Base Oil and Wax Processing, Avilino Sequeira, Jr., Marcel Dekker, Inc., NY 1994.

Ryland, Lloyd B., Tamele, M.W. and Wilson, J.N., Cracking Catalysts, *Catalysis*, vol. VII, NY 1960, pp. 5-9.

* cited by examiner

PROCESS TO PREPARE A LUBRICATING BASE OIL

PRIORITY CLAIM

The present application claims priority on European Patent Application 03253947.0 filed 23 Jun. 2003.

FIELD OF THE INVENTION

The invention relates to a process to prepare a base oil having a viscosity index of above 80 and a saturates content of above 90 wt % from a crude derived feedstock by means of a process comprising a hydrocracking step and a catalytic dewaxing step.

BACKGROUND OF THE INVENTION

EP-A-0909304 illustrates a process wherein a base oil having a viscosity index (VI) of 95 is prepared from a vacuum distillate boiling between 418 (5 wt % recovery) and 564° C. (95 wt % recovery) by subjecting the feed to a hydrocracking step using a catalyst based on Nickel and Molybdenum. The high boiling part of the hydrocracker effluent was subsequently dewaxed using a ZSM-5 based dewaxing catalyst and hydrofinished using a platinum/palladium based catalyst. The yield to base oil was 62 wt %.

WO-A-0250213 describes a process to prepare a base oil from the high boiling fraction of a fuels hydrocracker process. In this process the high boiling fraction is separated into different distillate fractions which are in turn subjected to a catalytic dewaxing step and a hydrofinishing step.

U.S. Pat. No. 5,525,209 describes a fuels hydrocracker process wherein the bottoms fraction in which bottoms fraction may potentially yield a base oil having a desired high viscosity index value. It is shown in this publication that the viscosity index of the base oil will increase at higher conversion in the hydrocracker step.

According to general textbooks on base oil manufacturing hydrocracking will reduce the viscosity of the feedstock, remove most of the nitrogen, oxygen and sulphur present in the base oil feedstock and convert the undesirable low VI materials such as polynuclear aromatics and polynuclear naphthenes to higher VI materials such as mononuclear aromatics, mononuclear naphthenes and iso-paraffins (Chapter 6 and especially page 122 of Lubricant Base Oil and Wax Processing, Avilino Sequeira, Jr, Marcel Dekker Inc, New York, 1994, ISBN 0-8247-9256-4).

A disadvantage of the above processes is that not all crude derived feedstocks are suitable for preparing a base oil having the desired VI. It may also be possible that a crude derived feed is suitable to meet the VI requirements of some but not all of the desired viscosity grades. This could for example be due to the fact that the content of polynuclear aromatics and naphthenics in the relevant feed or feed fraction are too high. It may sometimes be possible to meet the VI requirements by increasing the hydrocracker conversion as explained above. However such a higher conversion will significantly lower the final base oil yield and may even make it impossible to prepare the heavier grades.

EP-A-921184 describes a process wherein a Fischer-Tropsch wax is added to a crude derived oil. This mixture is used as feed to a hydrocracker. The effluent of the hydrocracker is distilled and a bottom fraction is recovered. This distiller bottom fraction is subjected to a solvent dewaxing treatment to obtain a base oil having a viscosity index of 145 or greater and a kinematic viscosity at 100° C. of between 4.6 and 6.3 cSt.

According to EP-A-921184 the Fischer-Tropsch wax to be used in the disclosed process is isolated from the Fischer-Tropsch synthesis product by only distillation. Typically more than 80% by volume has a boiling point higher than 550° C. One such wax was exemplified and because a substantially normal-paraffinic mixture is expected for such a direct Fischer-Tropsch wax fraction a congealing point of around 100° C. is estimated. This wax was mixed with a petroleum based waxy distillate having a final boiling point of 579° C. and the mixture was subjected to a hydrocracking step. From the examples it can be seen that when the Fischer-Tropsch wax containing feed was used a large fraction boiling above 635° C. was found in the effluent of the hydrocracker.

A disadvantage of the process according to EP-A-921184 is that a large portion of the valuable Fischer-Tropsch molecules added to the hydrocracker feed do not end up in the final base oils.

It would be useful to provide a process to make base oils from a crude derived feedstock wherein use is made of a Fischer-Tropsch derived product in a more efficient manner

SUMMARY OF THE INVENTION

The invention provides a process to prepare a base oil having a viscosity index of above 80 and a saturates content of above 90 wt % from a crude derived feedstock comprising (a) contacting a crude derived feedstock in the presence of hydrogen with a catalyst comprising at least one Group VIB metal component and at least one non-noble Group VIII metal component supported on a refractory oxide carrier;

(b) adding to the effluent of step (a) or part of the effluent of step (a) a Fischer-Tropsch derived fraction boiling at least partly in the base oil range in an amount effective to achieve the target viscosity index of the final base oil; and (c) dewaxing the mixture as obtained in step (b).

DETAILED DESCRIPTION OF THE INVENTION

Applicants found that the use of Fischer-Tropsch fraction in the process according the invention greatly improves the flexibility of the process. Feedstocks derived from crudes which normally did not yield a base oil having the desired VI could now be used and/or the yield of base oil as calculated on the petroleum derived feedstock could be improved. Applicants also found that base oils having a kinematic viscosity at 100° C. of greater than 7 cSt, preferably greater than 8 cSt having a viscosity index of greater than 80, preferably between 95 and 120 or even greater than 120 and preferably between 120 and 140 can be obtained in a good yield.

The petroleum derived feedstock as used in step (a) may be a vacuum distillate fraction as obtained from the residue of the atmospheric distillation of a crude petroleum feed. Such a fraction may be a vacuum gas oil or heavier fractions. The residue of the vacuum distillation itself may also be used. Suitably a vacuum residue is used which has been de-asphalted. Other possible feeds are for example the cycle oils as obtained in a fluid catalytic cracking process. Mixtures of the above feeds are of course also possible. If heavy base oil grades are preferred a feed is used wherein more than 10 wt %, preferably more than 20 wt % and most preferably more than 30 wt % of the compounds present in said feed boil above 470° C. Suitably less than 60 wt % of the compounds present in the feed boil above 470° C.

The feed to step (a) will typically have a low VI value of below 60 due to the presence of polynuclear aromatics and naphthenics. The VI of the feed as here defined is the VI of a solvent dewaxed sample having a pour point of −18° C.

Step (a) may be performed according to well known hydrocracking processes. These processes may be both hydrocracking processes known to make primarily middle distillates and base oil hydrocracking processes. The conversion in step (a), expressed in the weight percentage of the fraction in the feed which boils above 370° C. which is converted to products boiling below 370° C., in step (a) may thus range from values typical for base oil hydrocrackers and to values typical for fuels hydrocrackers. Such conversions may thus be between 20 and 80 wt %. The degree of conversion will depend on the feedstock quality as explained above and the availability of the Fischer-Tropsch derived blending fraction. A skilled person will be able to optimise the conversion given these parameters.

Step (a) may in addition also comprise a hydrotreating step performed prior to the actual hydrocracking step. In the hydrotreating step nitrogen and sulphur are removed and aromatics are saturated to naphthenes. The reduction in sulphur and nitrogen is preferably such that the feed to step (c) is below 100 ppmw sulphur and more preferably below 50 ppm sulphur and more preferably below 10 ppmw nitrogen.

It has been found that in the process according to the present invention a base oil may be prepared having the desired VI wherein the conversion in the hydrotreating step is relatively low. This is especially advantageous when heavier grades are also desired. The conversion is preferably below 40 and more preferably below 30 wt %. The preliminary hydrotreating step is typically performed using catalyst comprising a metal hydrogenation component, suitably a combination of a Group VIB and a non-noble Group VIII metal, for example cobalt-molybdenum, nickel-molybdenum, on a porous support, for example silica-alumina or alumina. The hydrotreating catalysts suitably contains no zeolite material or a very low content of less than 1 wt %. Examples of suitable hydrotreating catalysts are the commercial ICR 106, ICR 120 of Chevron Research and Technology Co.; 244, 411, DN-120, DN-180, DN-190 and DN-200, DN-3110, DN-3100 and DN-3120 of Criterion Catalyst Co.; TK-555 and TK-565 of Haldor Topsoe A/S; HC-k, HC-P, HC-R and HC-T of UOP; KF-742, KF-752, KF-846, KF-848 STARS and KF-849 of AKZO Nobel/Nippon Ketjen; and HR-438/448 of Procatalyse SA.

The hydrotreating step is suitably performed at the following conditions: temperature of at least 300° C., preferably from 350 to 450° C. and even more preferably from 370 to 430° C. Operating pressure may range from 10 to 250 bar, but preferably is at least 80 bar, more preferably at least 110 bar. In a particularly advantageous embodiment the operating pressure is in the range of from 110 to 170 bar. The weight hourly space velocity (WHSV) may range from 0.1 to 10 kg of oil per litre of catalyst per hour (kg/l.h) and suitably is in the range from 0.2 to 5 kg/l.h.

The hydrocracking step may be any hydrocracking process using well known hydrocracking catalysts or variations of such catalysts having a hydrogenation/dehydrogenation function on a suitable support. Such a function is preferably a Group VIII/Group VIB metal combination, for example nickel-molybdenum and nickel-tungsten. The support is preferably a porous support, for example silica-alumina and alumina. The catalyst may also comprise an, optionally partly dealuminated large pore size zeolite. Examples of suitable zeolites are zeolite X, Y, ZSM-3, ZSM-18, ZSM-20 and zeolite beta of which partly dealuminated zeolite Y is most preferred. Examples of suitable hydrocracking catalysts are the commercial ICR 220 and ICR 142 of Chevron Research and Technology Co; Z-763, Z-863, Z-753, Z-703, Z-803, Z-733, Z-723, Z-673, Z-603 and Z-623 of Zeolist International; TK-931 of Haldor Topsoe A/S; DHC-32, DHC-41, HC-24, HC-26, HC-34 and HC-43 of UOP; KC2600/1, KC2602, KC2610, KC2702 and KC2710 of AKZO Nobel/Nippon Ketjen; and HYC 642 and HYC 652 of Procatalyse SA.

The hydrocracking step is suitably performed at the following conditions: temperature of at least 300° C., preferably from 340 to 450° C. and even more preferably from 350 to 430° C. Operating pressure may range from 10 to 250 bar, but preferably is at least 80 bar, more preferably at least 110 bar. In a particularly advantageous embodiment the operating pressure is in the range of from 110 to 170 bar. The weight hourly space velocity (WHSV) may range from 0.1 to 10 kg of oil per litre of catalyst per hour (kg/l.h) and suitably is in the range from 0.2 to 5 kg/l.h.

In step (b) all or part of the effluent of step (a) is mixed with the Fischer-Tropsch derived fraction. Preferably only the fraction of said effluent boiling in the base oil range is used in step (a). Suitably this fraction has an initial boiling point higher than 300° C. and more preferably higher than 340° C. A maximum value for the initial boiling point will depend on the desired base oil grade.

The Fischer-Tropsch fraction may in principle be any fraction which boils in the base oil range and which is isolated from the synthesis product of the Fischer-Tropsch reaction. More preferably a partly or substantially completely hydroisomerized Fischer-Tropsch wax is used. The use of the isomerised product is preferred because a significant part of the normal paraffins as present in a Fischer-Tropsch synthesis product have then been isomerised to the, for base oil manufacture, more desirable iso-paraffins. The Fischer-Tropsch fraction preferably has a boiling range which corresponds with the petroleum derived fraction as used in step (b).

The Fischer-Tropsch derived fraction may be obtained by well-known processes, for example the so-called commercial Sasol process, the Shell Middle Distillate Process or by the non-commercial Exxon process. These and other processes are for example described in more detail in EP-A-776959, EP-A-668342, U.S. Pat. No. 4,943,672, U.S. Pat. No. 5,059,299, WO-A-9934917 and WO-A-9920720. The process will generally comprise a Fischer-Tropsch synthesis and a hydroisomerisation step as described in these publications. Preferably the fraction will comprise of a substantial amount of compounds boiling in the base oil range. The fraction preferably has a relatively low pour point, which is beneficial when the Fischer-Tropsch fraction has to be transported from remote locations to the base oil process facility. For this reason the Fischer-Tropsch fraction has been partly isomerised. More preferably the Fischer-Tropsch fraction may be partly isomerised to substantially totally isomerised. Preferably the content of normal paraffins in the partly isomerised fraction is between 4 and 20 wt %, more preferably between 5 and 15 wt %. A preferred partly isomerised Fischer-Tropsch fraction will boil for more than 90 wt % above 300° C. and more preferably above 340° C. The $Y_{90wt\%}$ recovery point is preferably above 500° C. and more preferably between 500 and 650° C. The fraction will preferably have a congealing point below 80° C., more preferably below 60° C. and even more preferably below 50° C. The wax content of this partly isomerised Fischer-Tropsch fraction is preferably below 50 wt %, more preferably below 30 wt %. The lower wax content of such a fraction is suitably above 1 wt % wax, preferably above 5 wt % wax and more preferably above 10 wt % wax. The wax content is determined by separating the wax component at −27° C. by means of solvent dewaxing using a 50/50 (vol/vol) MEKIFoluene solvent. Distillate fractions of the above described partly isomerised Fischer-Tropsch fraction may also be used in the process of the present invention when one seeks to improve only the properties of a specific base oil grade as also explained below. An example of a suitable partly isomerised fraction is the so-called Shell MDS Waxy Raffinate as obtainable from Shell MDS (Malaysia) Sdn Bhd or the product as described in WO-A-02070630 or fractions of said products. Partly isomerised Fischer-Tropsch feeds may be used in processes involving both solvent and catalytic dewaxing.

As described above, the isomerised Fischer-Tropsch fraction may be substantially totally isomerised. The degree of total isomerisation is expressed in its pour point, which is for such a totally isomerised fraction below −10° C. and suitably below −15° C. These oils may be obtained by dewaxing the above-described partly isomerised Fischer-Tropsch fraction or by performing the hydroisomerisation step at a high conversion, suitably above 50 wt % per pass, preferably above 60 wt % on a preferably heavy Fischer-Tropsch wax feed having a weight ratio of compounds having more than 60 carbon atoms relative to compounds having more than 30 carbon atoms of above 0.4, preferably above 0.55. The conversion is defined as the compounds boiling above 370° C. in the feed that are converted to compounds boiling below 370° C. These totally isomerised fractions may be considered to be suitable to be used as base oils themselves. However they contain for some uses a too high a content of paraffins, which paraffins influences the solvency for additives in a negative manner. By using a blend of this isomerised Fischer-Tropsch fraction in step (b) it is possible to prepare a base oil in step (c) which will have the desired level of paraffins at exactly the right pour point of the and product. If the dewaxed oil is fractionated to separate light components and optionally isolate more than one base oil grade a base oil product is obtained having also just the right Noack volatility and viscosity. This would not be achieved in such a simple manner if the totally isomerised Fischer-Tropsch fraction was to be added to a finished base oil because properties like viscosity, volatility and pour point would in most cases not match such to obtain exactly the desired base oil product.

The totally isomerised Fischer-Tropsch fraction will preferably boil for more than 90 wt % above 300° C. and more preferably above 340° C. The $T_{90wt\%}$ recovery point is preferably above 500° C. and more preferably between 500 and 650° C.

Distillate fractions of this totally isomerised Fischer-Tropsch fraction may also be used in the process of the present invention when one seeks to improve only the properties of a specific base oil grade as also explained below.

Alternatively, but less preferred than the partly or totally isomerised Fischer-Tropsch products, one may use as the Fischer-Tropsch fraction the n-paraffin waxes as obtainable from said Fischer-Tropsch processes having preferably a congealing point of between 20 and 80° C. Examples are SX-30, SX-50 and SX-70 as obtainable from Shell MDS (Malaysia) Sdn Bhd. If such waxes are used a catalytic dewaxing in step (c) is preferred, more preferably a dewaxing catalyst is used having a high ability to isomerise the normal paraffins. See preferred catalysts below. Fractions having similar properties as described above as obtainable from other processes may also be advantageously used in our invention.

The mixture as obtained in step (b) will suitably have a viscosity corresponding to the desired viscosity of the base oil product. Preferably the kinematic viscosity at 100° C. of the mixture is between 3 and 10 cSt. The content of Fischer-Tropsch derived fraction in the mixture is preferably higher than 5 wt %, more preferably higher than 10 wt % and preferably lower than 50 wt % and more preferably below 30 wt % and even more preferably below 25 wt %.

With the dewaxing in step (c) is understood every process wherein the pour point of the base oil is reduced by more than 10° C., preferably more than 20° C., more preferably more than 25° C. The dewaxing can be performed by means of a so-called solvent dewaxing process or by means of a catalytic dewaxing process. Solvent dewaxing is well known to those skilled in the art and involves admixture of one or more solvents and/or wax precipitating agents with the base oil precursor fraction and cooling the mixture to a temperature in the range of from −10° C. to −40° C., preferably in the range of from −20° C. to −35° C., to separate the wax from the oil. The oil containing the wax is usually filtered through a filter cloth which can be made of textile fibres, such as cotton; porous metal cloth; or cloth made of synthetic materials. Examples of solvents which may be employed in the solvent dewaxing process are $C_3$-$C_6$ ketones (e.g. methyl ethyl ketone, methyl isobutyl ketone and mixtures thereof), $C_6$-$C_{10}$ aromatic hydrocarbons (e.g. toluene), mixtures of ketones and aromatics (e.g. methyl ethyl ketone and toluene), autorefrigerative solvents such as liquefied, normally gaseous $C_2$-$C_4$ hydrocarbons such as propane, propylene, butane, butylene and mixtures thereof. Mixtures of methyl ethyl ketone and toluene or methyl ethyl ketone and methyl isobutyl ketone are generally preferred. Examples of these and other suitable solvent dewaxing processes are described in Lubricant Base Oil and Wax Processing, Avilino Sequeira, Jr, Marcel Dekker Inc., New York, 1994, Chapter 7.

Preferably step (c) is performed by means of a catalytic dewaxing process. The catalytic dewaxing step (c) can be performed by any process wherein in the presence of a catalyst and hydrogen the pour point of the base oil precursor fraction is reduced as specified above. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of the distillate base oil precursor fraction under catalytic dewaxing conditions. Preferably the intermediate pore size zeolites have a pore diameter of between 0.35 and 0.8 nm. Suitable intermediate pore size zeolites are mordenite, ZSM-5, ZSM-12, ZSM-22, ZSM-23, SSZ-32, ZSM-35 and ZSM-48. Catalysts having a high ability to isomerise normal paraffins will preferably comprise ZSM-12, ZSM-22, ZSM-23 or SSZ-32. Another preferred group of molecular sieves are the silica-aluminaphosphate (SAPO) materials of which SAPO-11 is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Ni/ZSM-5, Pt/ZSM-23, Pd/ZSM-23, Pt/ZSM-48 and Pt/SAPO-11. Further details and examples of suitable molecular sieves and dewaxing conditions are for example described in WO-A-9718278, U.S. Pat. No. 5,053,373, U.S. Pat. No. 5,252,527, U.S. Pat. No. 4,574,043, WO-A-2004033594 and WO-A-2004033593.

The dewaxing catalyst suitably also comprises a binder. The binder may be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material, which is essentially free of alumina, is used. Examples of these binder materials are silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment is by contacting an extrudate of the binder and the zeolite with an aqueous solution of a fluorosilicate salt as described in for example U.S. Pat. No. 5,157,191 or WO-A-2000029511. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22 as for example described in WO-A-200029511 and EP-B-832171.

Catalytic dewaxing conditions are known in the art and typically involve operating temperatures in the range of from 200 to 500° C., suitably from 250 to 400° C., hydrogen pressures in the range of from 10 to 200 bar, preferably from 40 to 170 bar, weight hourly space velocities (WHSV) in the range of from 0.1 to 10 kg of oil per litre of catalyst per hour (kg/l/hr), suitably from 0.2 to 5 kg/l/hr, more suitably from 0.5 to 3 kg/l/hr and hydrogen to oil ratios in the range of from 100 to 2,000 litres of hydrogen per litre of oil. By varying the temperature between 315 and 375° C. at between 40-70 bars, in the catalytic dewaxing step it is possible to prepare base oils having different pour point specifications varying from suitably lower than −60 to −10° C.

If the feed to a catalytic dewaxing step (c) has a relatively high nitrogen content of above 10 ppm a pre-treat step is preferably performed wherein under hydroconversion conditions similar to the dewaxing conditions the feed to step (c) is contacted with a noble metal catalyst. Examples of suitable noble metal catalysts are the palladium/platinum containing catalysts C-624 and C-654 of Criterion Catalyst Company. After such a treatment the nitrogen content is reduced to below 10 ppm that is advantageous for the performance of the dewaxing catalyst downstream said treatment.

After performing the pour point reducing treatment lower boiling compounds formed during said treatment are suitably removed, preferably by means of distillation, optionally in combination with an initial flashing step.

The effluent of the pour point reducing treatment may suitably be subjected to a hydrogenation treatment step (d). Hydrogenation may be performed on the entire effluent or on specific base oil grades after the above-described fractionation. This may be required in order to increase the content of saturate compounds to values above 90 wt % more preferably above 95 wt %. Such a hydrogenation is also referred to as a hydrofinishing step. This step is suitably carried out at a temperature between 180 and 380° C., a total pressure of between 10 to 250 bar and preferably above 100 bar and more preferably between 120 and 250 bar. The WHSV (Weight hourly space velocity) ranges from 0.3 to 2 kg of oil per litre of catalyst per hour (kg/l.h). Optionally the hydrogenation is performed in the same reactor as the catalytic dewaxing reactor. In such a reactor the beds of dewaxing catalyst and hydrogenation catalyst will be placed in a stacked bed on top of each other.

The hydrogenation catalyst is suitably a supported catalyst comprising a dispersed Group VIII metal. Possible Group VIII metals are cobalt, nickel, palladium and platinum. Cobalt and nickel containing catalysts may also comprise a Group VIB metal, suitably molybdenum and tungsten. Suitable carrier or support materials are low acidity amorphous refractory oxides. Examples of suitable amorphous refractory oxides include inorganic oxides, such as alumina, silica, titania, zirconia, boria, silica-alumina, fluorided alumina, fluorided silica-alumina and mixtures of two or more of these.

Examples of suitable hydrogenation catalysts are nickel-molybdenum containing catalyst such as KF-847 and KF-8010 (AKZO Nobel) M-8-24 and M-8-25 (BASF), and C-424, DN-190, HDS-3 and HDS-4 (Criterion); nickel-tungsten containing catalysts such as NI-4342 and NI-4352 (Engelhard) and C-454 (Criterion); cobalt-molybdenum containing catalysts such as KF-330 (AKZO-Nobel), HDS-22 (Criterion) and HPC-601 (Engelhard). Preferably platinum containing and more preferably platinum and palladium containing catalysts are used. Preferred supports for these palladium and/or platinum containing catalysts are amorphous silica-alumina. Examples of suitable silica-alumina carriers are disclosed in WO-A-9410263. A preferred catalyst comprises an alloy of palladium and platinum preferably supported on an amorphous silica-alumina carrier of which the commercially available catalyst C-624 of Criterion Catalyst Company (Houston, Tex.) is an example.

With the process according to the present invention different base oil grades may be prepared, such as spindle oil, light machine oil and medium machine oil having a saturates content of above 90 wt %, more preferably higher than 95 wt %. In the context of the present invention terms as spindle oil, light machine oil and medium machine oil will refer to base oil grades having an increasing kinematic viscosity at 100° C. and wherein the spindle oil additionally has a maximum volatility specification. Preferably a spindle oil is a light base oil product having a kinematic viscosity at 100° C. of below 5.5 cSt and preferably above 3.5. The spindle oil can have either a Noack volatility, as determined by the CEC L-40-T87 method, of preferably below 20% and more preferably below 18% or a flash point, as measured according to ASTM D93, of above 180° C. Preferably the light machine oil has a kinematic viscosity at 100° C. of below 9 cSt and preferably above 6.5 cSt and more preferably between 8 and 9 cSt. Preferably the medium machine oil has a kinematic viscosity at 100° C. of below 13 cSt and preferably above 10 cSt and more preferably between 11 and 12.5 cSt. The corresponding base oil grade can have a viscosity index of between 95 and 120.

The above referred to base oils are typically API Group II base oils having a viscosity index of between 80 and 120. With the present invention it is also possible to prepare so-called API Group III base oils having a viscosity index of above 120 and preferably up to 140 by for example adding more of the Fischer-Tropsch derived fraction in step (b), adjusting the process conditions in step (a) or by using a crude derived feedstock which in itself yields a higher VI base oil. In the context of the present invention the content of the Fischer-Tropsch derived fraction in the mixture obtained in step (b) is less than 60 wt %, preferably less than 50 wt %.

The above base oil grades may be obtained by distilling the product as obtained after step (c) or step (d). In some base oil processing units comprising hydrocracking and catalytic dewaxing these base oil grades are prepared one at a time in a so-called blocked out mode as for example described by FIG.

1.1 on page 2 of the above referred to General Textbook of Avilino Sequeira Jr. Another option is that a full range feed is processed in step (a) and that from the effluent of step (a) fractions are isolated which correspond to the above spindle, light and medium machine oil grade as for example described in the above referred to WO-A-0250213. The individual grades are subsequently further processed in step (c) in a blocked out mode. In terms of the present invention one or more of these grades can be mixed with the Fischer-Tropsch fraction. When processing the different grades separately through steps (a) and/or (c) it is possible to use the Fischer-Tropsch fraction to correct only for those grades which need correction in VI. In a prior art process without having this possibility it was not possible to target the desired VI for every grade. In practice one would target the VI for the most difficult grade and accept a VI much higher than the specification for the remaining grades. As explained above a too high VI implicates a non-optimal yield for the base oil. This quality giveaway can now be avoided with the process according to the present process. The invention will be illustrated by the following non-limiting examples.

EXAMPLES 1

In Example 1 a blend of two components have been catalytically dewaxed. The first component was an intermediate product having the properties as listed in Table 1. This intermediate product was prepared by contacting a vacuum distillate feed first with a NiMo on alumina type hydrotreating catalyst(s) followed by contacting the hydrotreated fraction with a hydrocracking catalyst consisting of NiW on an alumina carrier wherein the hydrocracking catalyst contained 50 wt % zeolite Y. These two steps were performed at 150 bars hydrogen pressure. From the effluent middle distillates and lower boiling fractions were separated from the higher boiling intermediate product by means of distillation.

The second component was a partly isomerised Fischer-Tropsch derived fraction obtained from Shell MDS (Malaysia) Sdn Bhd marketed as Shell MDS Waxy Raffinate.

TABLE 1

| Component | | Intermediate product as made from a vacuum distillate of a crude mineral source | Shell MDS Waxy Raffinate as obtained from Shell MDS (Malaysia) Sdn Bhd |
|---|---|---|---|
| Example | | Example 1 | Example 1 |
| Content in blend | Wt % | 50 | 50 |
| Vk@100° C. | cSt | 4.982 | 5.181 |
| Refractive index | | 1.457 | |
| Density | | 824.2 | 784.3 |
| Wax melting point | ° C. | +47 | |
| IBP % m distilled | ° C. | 197 | 347 |
| 10 | " | 350 | 396 |
| 50 | " | 437 | 461 |
| 70 | " | 474 | 490 |
| 90 | " | 527 | 529 |
| FBP | " | 602 | 592 |
| Wax content (*) | Wt % | 20 | 21.4 |

(*) as determined after separating the wax component at −27° C. by means of solvent dewaxing.

The above blend, analysed for sulphur (44 ppm) and nitrogen (2 ppm), was contacted with a dewaxing catalyst 10 consisting of 0.7 wt % platinum, 25 wt % ZSM-12 and a silica binder. The dewaxing conditions were 140 bar hydrogen, WHSV=1 kg/l.h, and a hydrogen gas rate of 750 Nl/kg feed. The experiment was carried out at three different reaction temperatures: 339, 343 and 345° C.

The dewaxed effluent was cut at 470° C. and the 470° C. plus fraction was analysed. The properties of the 470° C. plus fraction are listed in Table 2. Higher viscosity grades could have been obtained at cutting the dewaxed oil at a higher temperature than the now exemplified 470° C.

TABLE 2

| | Example | | |
|---|---|---|---|
| | 1a | 1b | 1c |
| Reactor temperature | 339 | 343 | 345 |
| Yield on feed of 470 ° C. + fraction (wt %) | 29.5 | 26.4 | 25.3 |
| 470° C. + Pour Point (° C.) | −14 | −20 | −28 |
| Viscosity Index of the 470° C. + fraction | 130.1 | 127.4 | 124.3 |
| Kinematic viscosity at 100° C. (cSt) | 8.582 | 8.809 | 9.077 |

Comparative Experiment A

Example 1 was repeated except that the feed was 100% of the intermediate product as made from a vacuum distillate of a crude mineral source as listed in Table 1.

The reactor temperatures were again varied as listed in Table 3. The properties of the 470° C. plus fraction were analysed and reported in Table 3.

TABLE 3

| | | Experiment | | |
|---|---|---|---|---|
| | | A-1 | A-2 | A-3 |
| Reactor temperature | ° C. | 336 | 341 | 346 |
| Pour point | ° C. | −11 | −23 | −35 |
| Viscosity index | — | 103 | 100 | 94 |
| Kinematic viscosity at 100° C. | cSt | 11.51 | 11.77 | 12.89 |

We claim:

1. A process to prepare a base oil having a target viscosity index of above 80 and a saturates content of above 90 wt % from a crude derived feedstock by comprising (a) contacting a crude derived feedstock in the presence of hydrogen with a catalyst comprising at least one Group VIB metal component and at least one non-noble Group VIII metal component supported on a refractory oxide carrier to produce an effluent;

(b) adding to the effluent of step (a) or part of the effluent of step (a) a Fischer-Tropsch-derived fraction boiling at least partly in the base oil range, wherein the Fischer-Tropsch derived fraction is obtained by hydroisomerization of a Fischer-Tropsch synthesis product, in an amount effective to achieve the target viscosity index of the final base oil to produce a mixture; and (c) dewaxing the mixture as obtained in step (b).

2. The process of claim 1, wherein the crude derived feedstock is a vacuum distillate fraction or a de-asphalted vacuum residue as obtained from the residue of an atmospheric distillation of a crude petroleum feed.

3. The process of claim 2, wherein the viscosity index of the crude derived feedstock is below 60.

4. The process of claim 2, wherein the conversion in step (a) is between 20 and 80 wt %.

5. The process of claim 2, wherein in step (a) the crude derived feedstock is first subjected to a hydrotreating step prior to the hydrocracking step.

6. The process of claim 5, wherein the conversion in the hydrotreating step is below 30 wt %.

7. The process of claim 2, wherein the kinematic viscosity at 100° C. of the mixture as obtained in step (b) is between 3 and 10 cSt.

8. The process of claim 2, wherein step (c) comprises of catalytic dewaxing.

9. The process of claim 2, wherein the dewaxed product of step (c) is subjected to an additional hydrogenation treatment step (d).

10. The process of claim 2, wherein the Fischer-Tropsch derived fraction is a partly isomerized fraction boiling for more than 90 wt % above 300° C., having a congealing point below 80° C. and a wax content of below 50 wt %.

11. The process of of claim 1, wherein the viscosity index of the crude derived feedstock is below 60.

12. The process of claim 1, wherein the conversion in step (a) is between 20 and 80 wt %.

13. The process of claim 1, wherein prior to step (a), the crude derived feedstock is first subjected to a hydrotreating step.

14. The process of claim 13, wherein the conversion in the hydrotreating step is below 30 wt %.

15. The process of claim 1, wherein the kinematic viscosity at 100° C. of the mixture as obtained in step (b) is between 3 and 10 cSt.

16. The process claim 1, wherein step (c) comprises catalytic dewaxing.

17. The process of claim 1, wherein the dewaxed product of step (c) is subjected to an additional hydrogenation treatment step (d).

18. The process of claim 1, wherein the Fischer-Tropsch derived fraction is a partly isomerized fraction boiling for more than 90 wt % above 300° C., having a congealing point below 80° C. and a wax content of below 50 wt %.

* * * * *